US005930856A

United States Patent [19]

Van Der Meyden et al.

[11] Patent Number: 5,930,856

[45] Date of Patent: Aug. 3, 1999

[54] AUTOMATIC SWIMMING POOL CLEANERS AND ASSOCIATED COMPONENTS

[75] Inventors: Hendrikus Johannes Van Der Meyden, Midrand, South Africa; James D. Scott, II, Boca Raton, Fla.

[73] Assignee: Baracuda International Corp., Ft. Lauderdale, Fla.

[21] Appl. No.: 08/838,513

[22] Filed: Apr. 8, 1997

[51] Int. Cl.[6] ..... E04H 4/16

[52] U.S. Cl. ..... 15/1.7; 440/40; 440/43

[58] Field of Search ..... 15/1.7; 440/40, 440/43; 114/222

[56] References Cited

U.S. PATENT DOCUMENTS

| | | | |
|---|---|---|---|
| 1,034,260 | 7/1912 | Lichtenberg | 15/304 |
| 2,027,543 | 1/1936 | Lofgren | 15/420 |
| 2,280,751 | 4/1942 | Davis | 15/364 |
| 3,046,583 | 7/1962 | Drennan | 15/1.7 |
| 3,071,101 | 1/1963 | Basso | 440/43 |
| 3,229,315 | 1/1966 | Watson | 15/1.7 |
| 3,243,830 | 4/1966 | Conrad | 15/420 |
| 3,753,265 | 8/1973 | Wulc | 15/1.7 |
| 4,100,641 | 7/1978 | Pansini | 15/1.7 |
| 4,129,904 | 12/1978 | Pansini | 15/1.7 |
| 4,254,525 | 3/1981 | Combest | 15/1.7 |
| 4,275,474 | 6/1981 | Woodard | 15/1.7 |
| 4,378,254 | 3/1983 | Chauvier | 15/1.7 |
| 4,558,479 | 12/1985 | Greskovics et al. | 15/1.7 |
| 4,581,075 | 4/1986 | St. Martin | 15/1.7 |
| 4,835,809 | 6/1989 | Roumagnac | 15/1.7 |
| 4,939,806 | 7/1990 | Supra | 15/1.7 |
| 5,128,031 | 7/1992 | Midkiff | 15/1.7 |
| 5,337,434 | 8/1994 | Erlich | 15/1.7 |
| 5,351,709 | 10/1994 | Vos | 15/1.7 |
| 5,400,467 | 3/1995 | Hwang | 15/364 |
| 5,546,982 | 8/1996 | Clark et al. | 137/557 |
| 5,720,068 | 2/1998 | Clark et al. | 15/1.7 |

FOREIGN PATENT DOCUMENTS

| | | |
|---|---|---|
| 0357810 | 3/1990 | European Pat. Off. . |
| 0380421 | 8/1990 | European Pat. Off. . |
| 0543387 | 5/1993 | European Pat. Off. . |
| 2365935 | 5/1978 | France . |
| 5-49568 | 3/1993 | Japan . |
| 139590 | 3/1993 | Sweden . |
| WO 96/13644 | 5/1996 | WIPO . |

*Primary Examiner*—Gary K. Graham

*Attorney, Agent, or Firm*—Dean W. Russell; Kilpatrick Stockton LLP

[57] ABSTRACT

Automatic swimming pool cleaning systems are disclosed. The systems include an automatic swimming pool cleaner incorporating one or more curved wipers protruding from its lower surface. The wipers and flat bottom of the cleaner induce a vortex as fluid flows to its central inlet, entraining debris in the flow. A fluted throat surrounding the inlet additionally assists the interior of the base of the cleaner in retaining debris when opened for cleaning, additionally providing an improved flow path for enhanced debris pick-up. Alternate embodiments incorporate a rudder and resistance plate for enhancing movement of the cleaners in the presence of obstacles. Also disclosed is a valve useful for controlling and indicating the rate of fluid flow to a cleaner. Included within the valve is a plunger attached to a spring, with the spring force opposing fluid flow through the valve. Flow sufficient to overcome the spring force compresses the spring, however, thereby moving the plunger within the tube and providing a dynamic indication of the rate of fluid flow. A diffuser and fluid release ports permit the valve to be adjusted to achieve a desired flow rate.

14 Claims, 7 Drawing Sheets

AUTOMATIC SWIMMING POOL CLEANERS AND ASSOCIATED COMPONENTS

FIELD OF THE INVENTION

This invention relates to automatic swimming pool cleaners and to valves and other components of or associated with such cleaners.

BACKGROUND OF THE INVENTION

U.S. Pat. No. 4,835,809 to Roumagnac, incorporated herein in its entirety by this reference, discloses various embodiments of an automatic device for cleaning swimming pools. The device includes a brush attached either to the lower edge or the bottom of its body to contact surfaces of the swimming pool and displace debris positioned there. According to the Roumagnac patent, the brush may be arched and of "substantially the same shape and length of the lower edge" of the body, for example, or "in the form of a circular cordon attached to the periphery of the bottom." Also included in the body of the device is an aspiration orifice, which may be annular, as shown in FIG. 5 of the Roumagnac patent, or "in the form of a narrow arched window" of FIG. 3.

SUMMARY OF THE INVENTION

The present invention provides an improved version of the device described in the Roumagnac patent. Rather than positioning a brush near the underside of the device, the cleaner of the present invention includes a series of curved wipers protruding from its lower surface. The wipers spiral inward toward a central inlet, causing water or other fluid encountering them to flow in the form of a vortex about the inlet when the cleaner operates. The arrangement of the wipers, together with the flat bottom of the cleaner, function to accelerate fluid flow toward the inlet, increasing the likelihood that debris entrained in the flow will remain suspended therein until entering the cleaner itself. All (or substantially all) radii of the cleaner centered at the inlet cross at least one wiper, moreover, so that the wipers effectively block fluid and debris from entering the inlet without having been captured by the vortex.

The cleaner of the present invention also defines a fluted throat surrounding the central inlet. Fluting the throat assists the interior of the base of the cleaner in retaining fluid and debris even when the cleaner is opened. This retention in turn facilitates orderly emptying of the cleaner, avoiding substantial fluid leakage when the interior of the cleaner is exposed. The present invention also provides access to the filter placed within the cleaner merely by removing the upper portion of the device.

An alternate embodiment of the invention includes a rudder to improve movement of the pool cleaner, especially when it encounters obstacles. Also included in such embodiment is an object (denoted a "resistance plate") positioned so as to slide along the exterior of the exhaust portion of the cleaner near the rudder. When the pool cleaner moves, the water drag resulting from the movement causes the resistance plate to slide toward the rudder, ultimately locking the rudder in a neutral position. When the rudder is neutrally oriented, the cleaner travels in a substantially straight line or path.

When the cleaner encounters an obstacle and its motion ceases, the resistance plate rebounds slightly and unlocks the rudder from the neutral position. Because the water flow through its associated portion of the cleaner is turbulent, the rudder position can become unstable and it moves, typically pivoting to one side or the other. Its doing so causes the associated portion to spin, reorienting the cleaner until straight-line motion can recommence.

Additionally included as part of the present invention is a valve for controlling and indicating the rate of fluid flow to an automatic swimming pool cleaner. The generally-tubular valve contains an internal plunger attached to a spring (or other resilient device) opposing fluid flow therethrough. Flow sufficient to overcome the spring force compresses the spring, thereby moving the plunger within the tube. By making the tube transparent, the relative position of the plunger may be used as a visual indicator of the rate of fluid flow through the valve.

Intermediate the inlet and plunger are one or more ports designed to release excess fluid when necessary to achieve a desired flow rate through the valve. The effective size of the ports, furthermore, is adjustable to vary the amount of fluid released as a function of time. The released fluid is then transferred into a tubular diffuser surrounding the corrugated hose typically attached to the outlet of the valve, with the corrugations acting to reduce the velocity and pressure of the released fluid before it exits the diffuser. The valve of the present invention is not limited to use in connection with corrugated hose, however, and may be employed successfully in other systems as well.

It is therefore an object of the present invention to provide an automatic swimming pool cleaner having multiple curved wipers protruding from its lower surface.

It is another object of the present invention to provide a pool cleaner in which the wipers spiral inward toward a central inlet.

It is also an object of the present invention to provide a pool cleaner which induces fluid to flow in a vortex entering the cleaner.

It is a further object of the present invention to provide an automatic swimming pool cleaner with a fluted throat defining the fluid inlet.

It is an additional object of the present invention to provide a cleaner having a rudder or steering mechanism designed to improve movement in a pool.

It is also an object of the present invention to provide a plate or other device adapted to fix the position of the rudder when appropriate or desired.

It is yet another object of the present invention to provide a valve for controlling and indicating the rate of fluid flow to an automatic swimming pool cleaner.

It is an additional object of the present invention to provide a valve including an internal plunger attached to a spring opposing fluid flow therethrough.

It is also an object of the present invention to provide a valve including fluid release ports and a diffuser for reducing the pressure and velocity of the released fluid.

Other objects, features, and advantages of the present invention will become apparent with reference to the remainder of the written portion and the drawings of this application.

DETAILED DESCRIPTION

Figure 1:
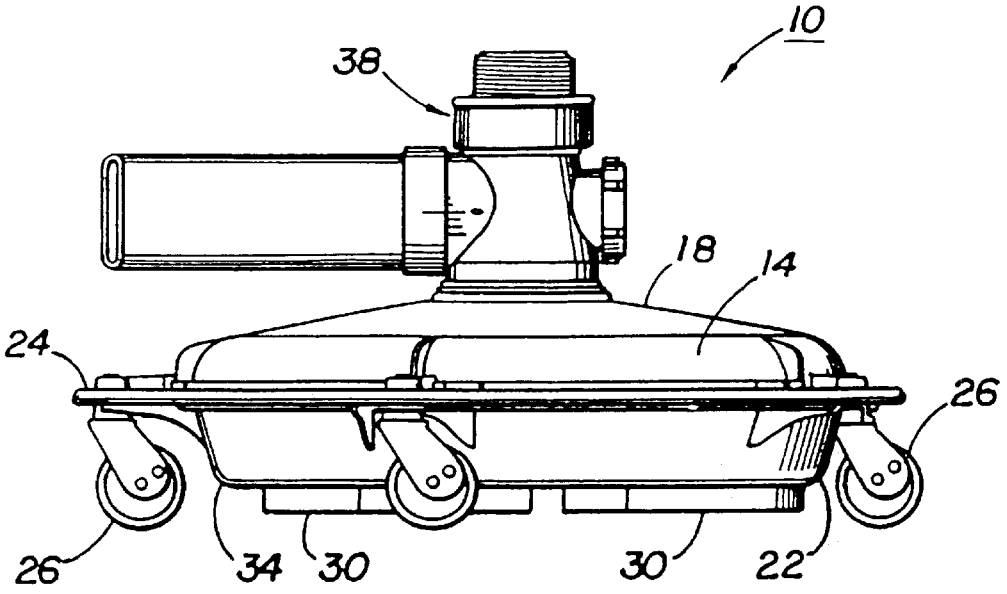
FIG. 1 is a side elevational view of a cleaner of the present invention.
Figure 2:
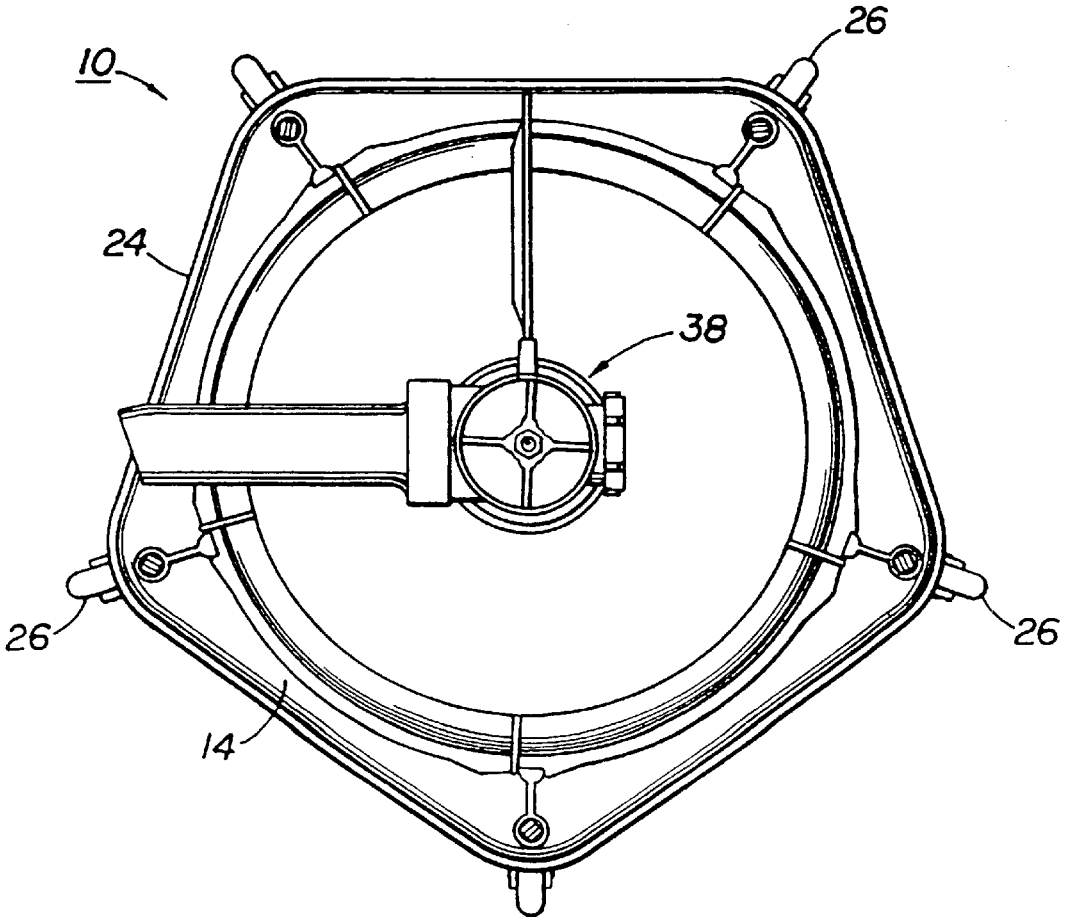
FIG. 2 is a top plan view of the cleaner of FIG. 1.

FIGS. 1–2 illustrate automatic swimming pool cleaner 10 of the present invention. Cleaner 10 includes body 14, comprising upper section 18 and lower section 22, which sections are fitted together in use. Shown in FIGS. 1–2 attached to lower section 22 about its periphery 24 are casters 26, while wipers 30 protrude from the bottom 34 of lower section 22. Connected to upper section 18 of body 14 is a hydro-injector 38 as described and illustrated in the Roumagnac patent. In use, cleaner 10 moves about a swimming pool or other vessel to be cleaned like the device of the Roumagnac patent.

Figure 3:
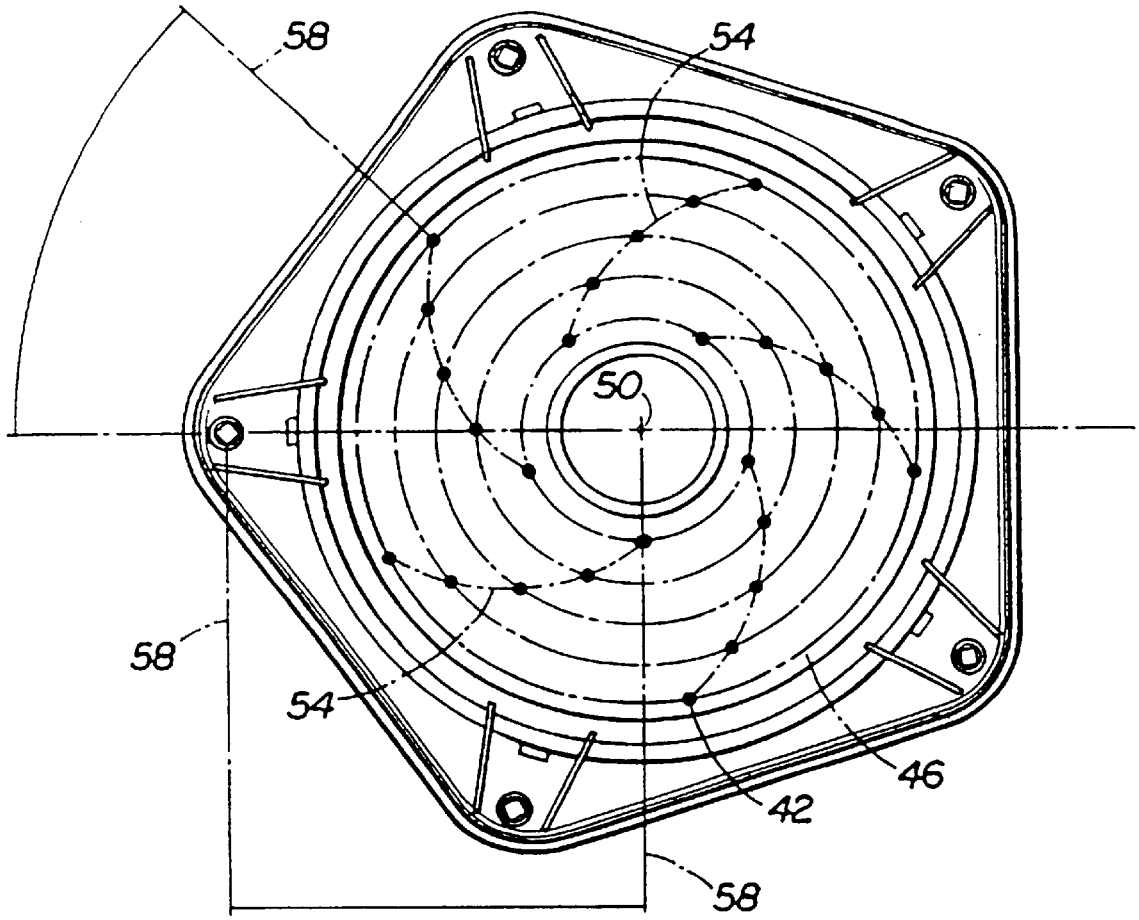
FIG. 3 is a top plan view of the lower section of the body of the cleaner of FIG. 1.
Figure 4:
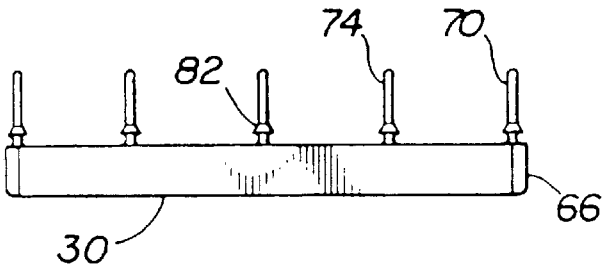
FIG. 4 is a side elevational view of a wiper designed to be included as part of the cleaner of FIG. 1.
Figure 4A:
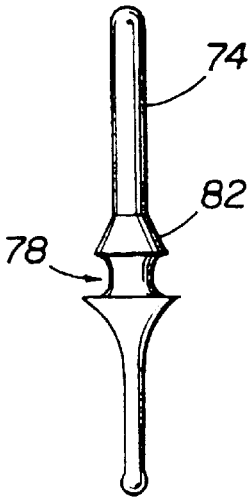
FIG. 4A is a side elevational view of a connector forming part of the wiper of FIG. 4.
Figure 5:
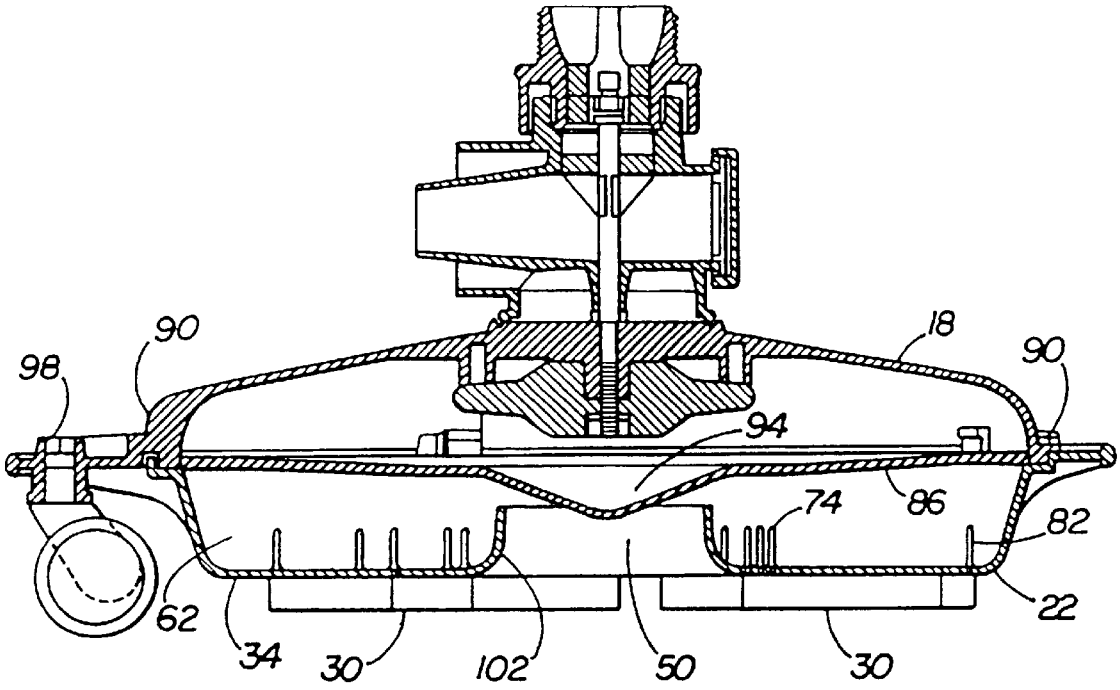
FIG. 5 is a cross-sectional view of the cleaner of FIG. 1.

FIGS. 3–5 detail the preferred placement of wipers 30 in cleaner 10. As detailed in FIGS. 3 and 5, lower section 18 include multiple openings 42 arranged in concentric circles 46 (shown as dotted lines) about central inlet 50. Selected sets of openings 42 define curves 54 (also shown as dotted lines), the preferred shape of wipers 30 in use. With wipers 30 so positioned on bottom 34 of lower section 22, all (or substantially all) radii 58 centered at central inlet 50 cross at least one wiper 30.

Wipers 30 thus spiral inward toward central inlet 50, causing water or other fluid encountering them to flow in the form of a vortex about central inlet 50 when cleaner 10 operates. Cooperating with the flat bottom 34 of lower section 22, wipers 30 function to accelerate fluid flow toward central inlet 50, increasing the likelihood that debris entrained in the flow will remain suspended therein until entering the interior 62 of body 14. Wipers 30 additionally effectively block fluid and debris from entering central inlet 50 without having been captured by the vortex.

Detailed in FIG. 4 is the nominal structure of wiper 30. Wiper 30 may be molded or otherwise formed of a flexible material such as plastic or rubber and comprise blade 66 and integrally-formed connectors 70. Each connector 70 of the type shown in FIG. 4 includes an elongated segment 74 terminating in flange assembly 78. Segment 74 has a diameter less than that of openings 42, facilitating its insertion therein, while flange assembly 78 includes flange 82 having a diameter greater than that of openings 42. Because wiper 30 is formed of compressible material, however, both segment 74 and flange 82 may be pulled through openings 42 into the interior 62 of body 14, after which flange 82 expands to lock wiper 30 in position. FIG. 5 illustrates wipers 30 as connected to lower section 22, with segment 74 and flange 82 protruding into interior 62.

Also shown in FIG. 5 is filter 86, which in some embodiments is a screen spanning lower section 22 within the interior 62 of body 14. Alternatively, filter 86 may be as described in the Roumagnac patent. In either event, filter 86 is designed to obstruct debris entrained in fluid entering central inlet 50 and retain the debris within interior 62. If desired, filter 86 may be fitted into or otherwise attached to lower section 22 or upper section 18 or, as illustrated in FIG. 5, placed on ledge 90 of the lower section 22 and retained using spring 94 extending from hydro-injector 38. Pins 98 connect casters 26 about the periphery 24 of lower section 22. Not encumbering upper section 18 with casters 26 facilitates removal of filter 86 from body 14, as the filter 86 becomes accessible merely by removing the unencumbered upper section 18.

Figure 6:
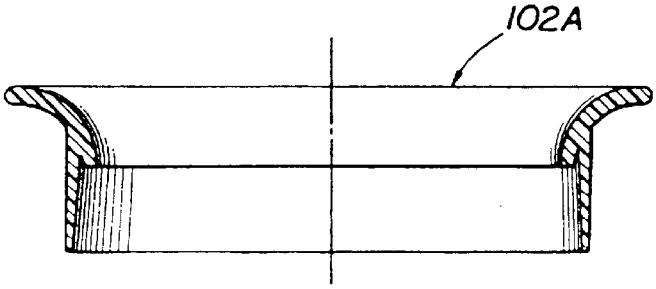
FIG. 6 is a cross-sectional view of a fluted throat that may be included as part of the cleaner of FIG. 1.

Throat 102 of lower section 22 defines central inlet 50. It additionally bounds the portion of interior 62 defined by lower section 22, reducing the possibility that debris settling therein can exit through central inlet 50 when hydro-injector 38 is not functioning. FIG. 6 illustrates an alternative throat 102A for cleaner 10. Unlike throat 102, throat 102A is fluted, providing an improved flow path for enhanced debris pick-up and forming an additional barrier to debris exiting interior 62 through central inlet 50 when not desired.

Figure 7:
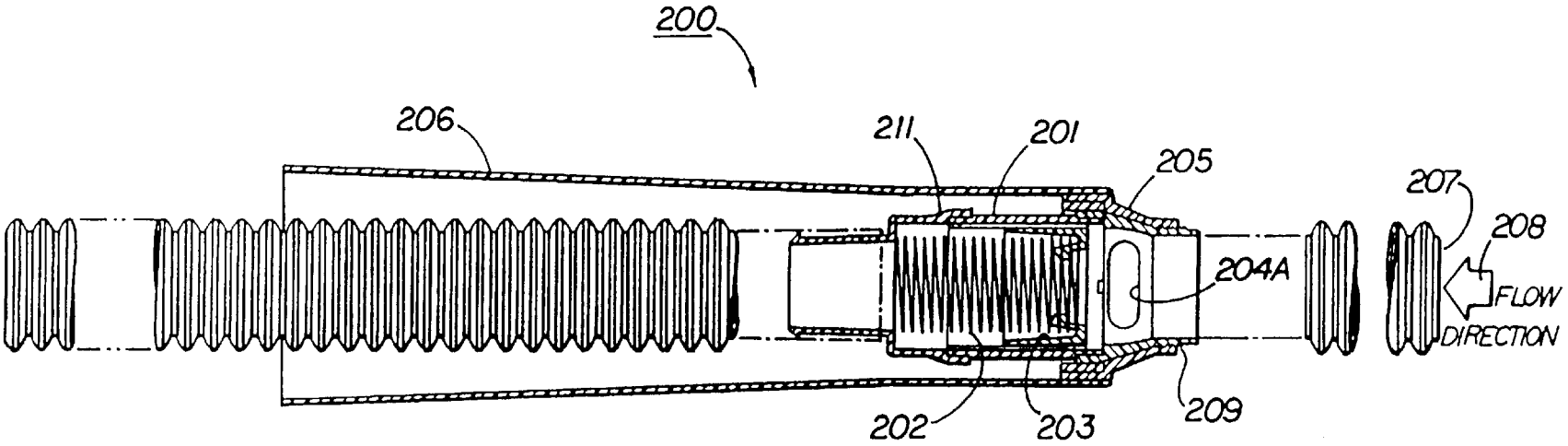
FIG. 7 is a partially-sectioned and -schematicized representation of a valve assembly forming part of the present invention and which may, if desired, be used in connection with the cleaner of FIG. 1.
Figure 8:
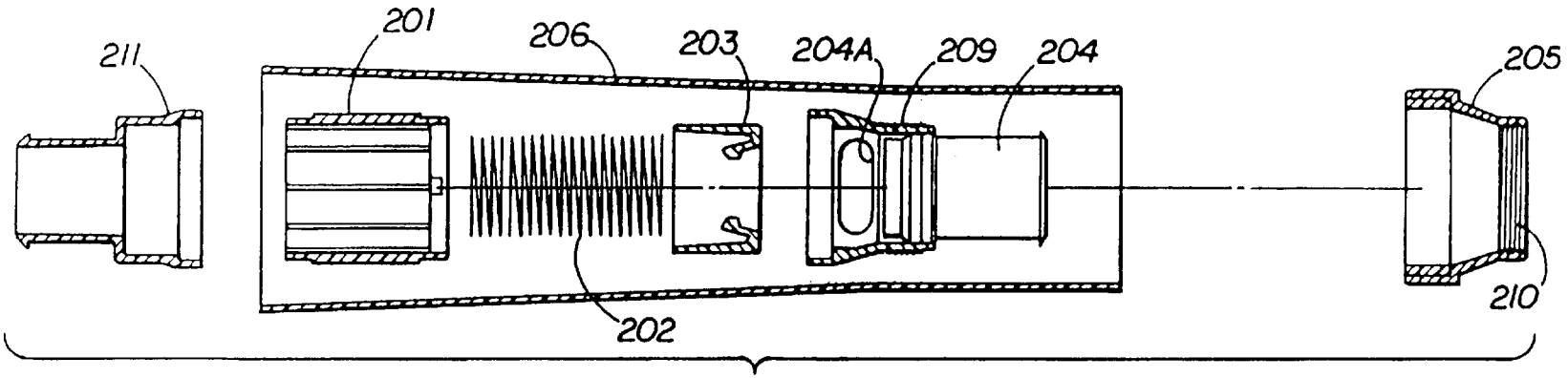
FIG. 8 is an exploded view of the valve assembly of FIG. 7.

FIGS. 7–8 disclose valve 200 which may be used to indicate and control the flow rate of fluid passing therethrough. Valve 200 includes tube 201 or other assembly, within which spring 202 and plunger 203 are positioned, as well as nozzle 204. Further shown in FIGS. 7–8 are nut 205, to which nozzle 204 attaches, diffuser 206, and fluid line 207 such as a corrugated hose. Included as part of nozzle 204 are one or more bypass ports 204A for diverting fluid into diffuser 206. Nozzle 204 also contains threaded section 209, which engages corresponding threaded section 210 of nut 205. Although valve 200 may be used in connection with cleaner 10 and an associated pump, it is not so limited and may be employed with other automatic swimming pool cleaning systems or used separately in any suitable fluid lines.

In use, fluid flows into valve 200 in the direction of arrow 208. Passing through nozzle 204, the fluid flow opposes the force of spring 202, causing the spring 202 to compress and attached plunger 203 to move. If tube 201 is partly or wholly transparent, the position of plunger 203 within the tube 201 may provide an indication external of the tube 201 of the rate of fluid flow through valve 200. Calibration using known equations for fluid and spring forces can permit the position of plunger 203 within tube 201 to evidence the flow rate of the fluid through the valve 200. The fluid continues to flow through exit adaptor 211 (when present) to fluid line 207, travelling to, for example, cleaner 10.

Nozzle 204, ports 204A, and nut 205 permit the fluid flow through valve 200 to be adjusted. Tightening nut 205 decreases the effective size of ports 204A, reducing the rate at which fluid is capable of exiting valve 200 through the ports 204A. By contrast, loosening nut 205 increases the effective size of ports 204A, permitting fluid to flow through ports 204A into diffuser 206 at a greater rate. The location of plunger 203 within tube 201 may be observed after each incremental change in the relative positions of nozzle 204 and nut 205, moreover, until the desired flow rate through valve 200 is achieved.

Fluid flowing through ports 204A enters diffuser 206, a tube or other analogous structure, that surrounds a portion of fluid line 207. In the embodiment of valve 200 shown in FIGS. 7–8, fluid line 207 is a corrugated hose, whose corrugations cooperate with diffuser 206 to decrease the velocity and pressure of the fluid within the diffuser 206. Although the corrugations are believed to facilitate the decrease in fluid velocity and pressure, fluid line 207 need not be a corrugated hose for diffuser 206 to operate, however. Furthermore, if corrugations are desired, they may be supplied by other structures such as exit adaptor 211.

Other embodiments of valve 200 may be fully automatic. In such cases ports 204A may be omitted from nozzle 204 and placed instead in tube 201. Movement of plunger 203 within tube 201 then will determine the effective area of ports 204A through which fluid may exit valve 200 through diffuser 206. With appropriate modifications valve 200 is also suitable for indicating and controlling the flow of fluid by suction into, for example, a pump. There, however, ports 204A would function to increase (rather than decrease) flow through valve 200, and diffuser 206 would serve as a vortex inhibitor instead of diffusing velocity and pressure.

Figure 9:
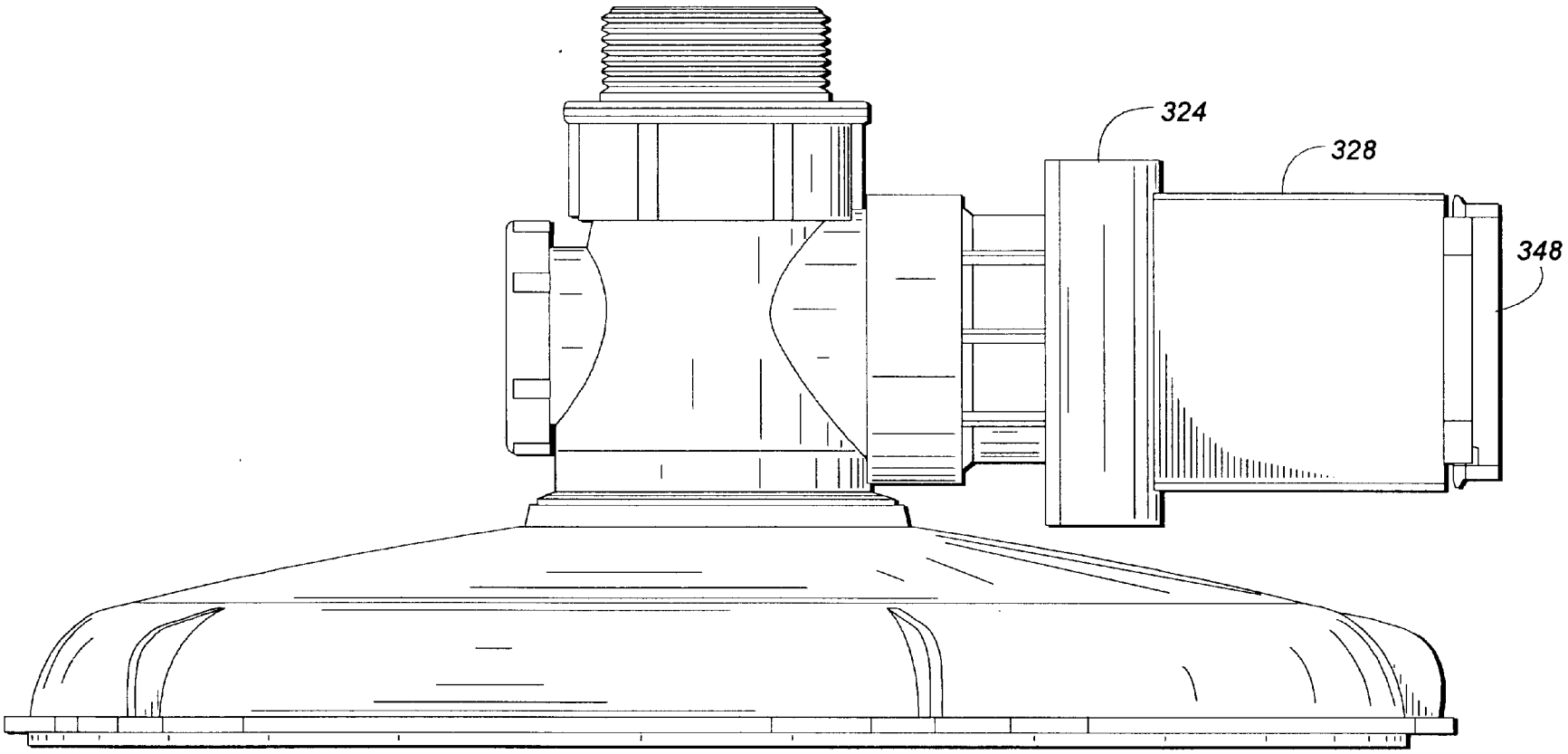
FIG. 9 is a side elevational view of a portion of an alternate embodiment of the cleaner of FIG. 1.
Figure 10:
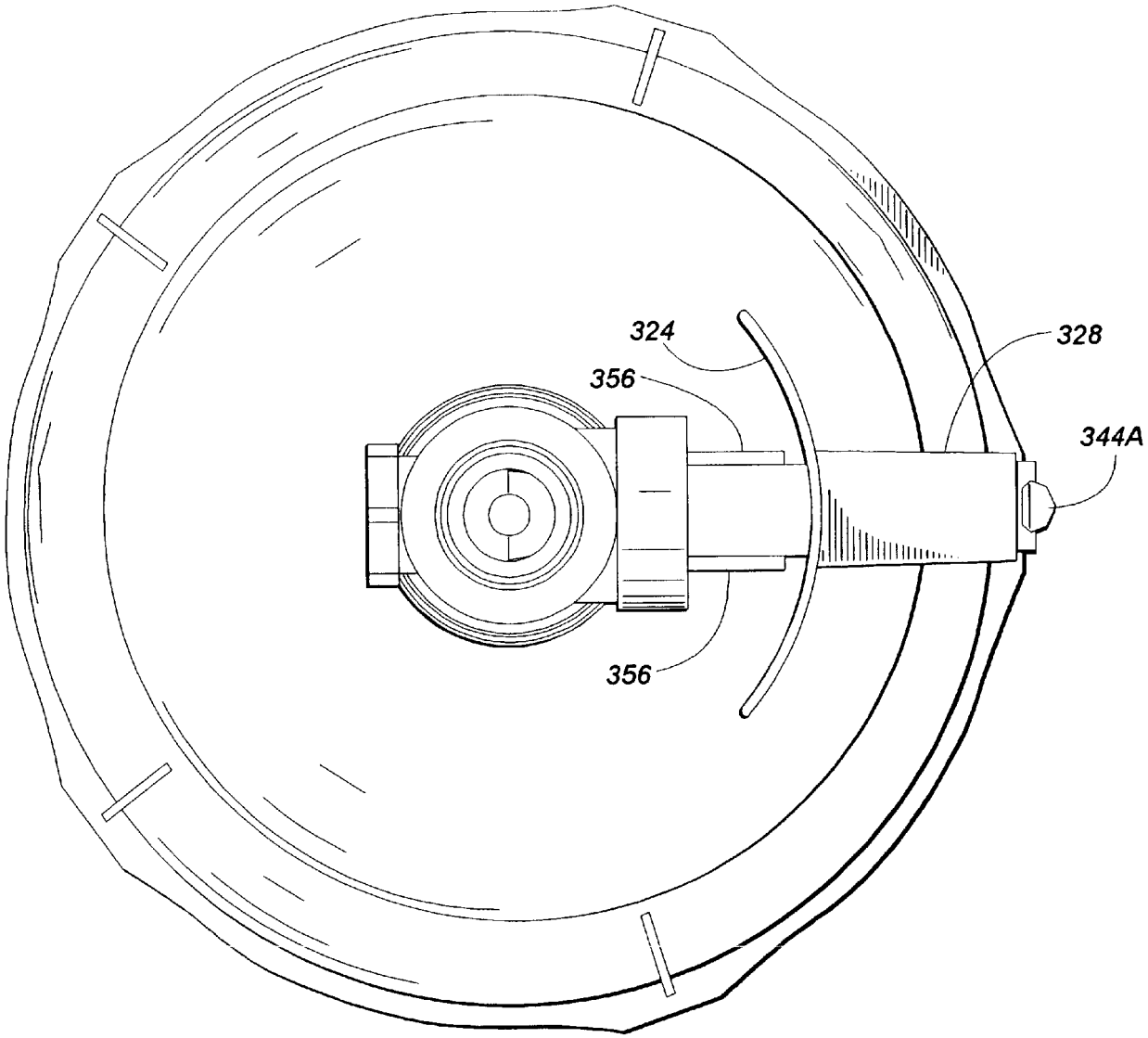
FIG. 10 is a top plan view of the portion of the cleaner shown in FIG. 9.
Figure 11:
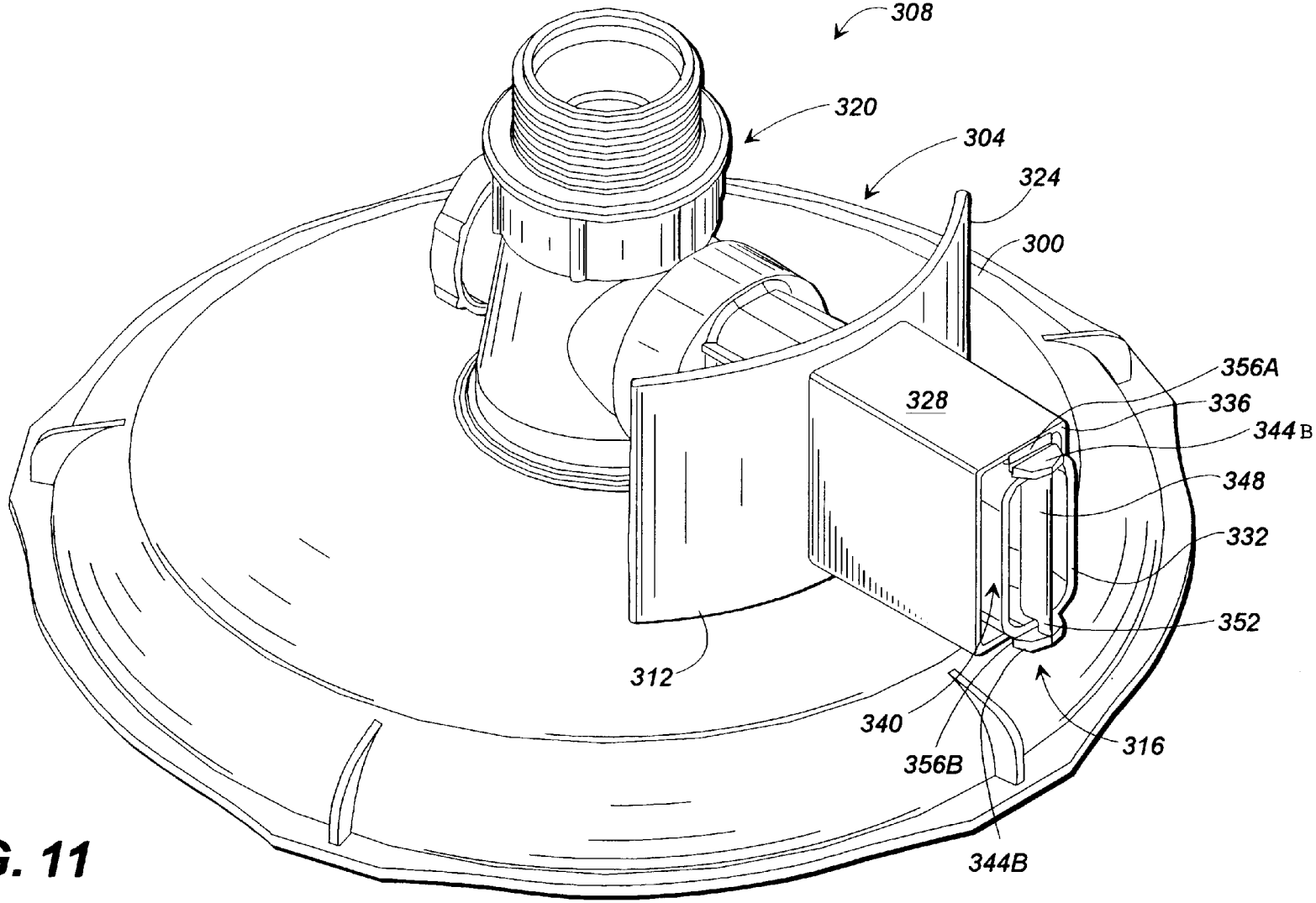
FIG. 11 is a perspective view of the portion of the cleaner shown in FIG. 9.

FIGS. 9–11 detail upper section 300 of body 304 of automatic swimming pool cleaner 308 of the present invention. Included as parts of cleaner 308 are resistance plate 312 and a steering mechanism such as rudder assembly 316. The remainder of body 304 of cleaner 308, as well as hydro-injector 320, may be similar to body 14 and hydro-injector 38, respectively, of corresponding cleaner 10.

Resistance plate 312 includes surface 324 (which may be curved if desired) and sleeve 328, which components cooperate and may (but need not) be integrally formed as shown in FIGS. 9–11. Sleeve 328 is fitted around exhaust pipe or port 332, terminating in a surface 336 adapted to abut rudder assembly 316. Although illustrated in FIGS. 9–11 as having rectangular cross section, sleeve 328 need not be so configured, but rather may assume any shape appropriate to accomplish its intended functions. Sleeve 328 is, however, designed so as to slide or otherwise move along exterior 340 of exhaust port 332.

Connected to exhaust port 332 is rudder assembly 316, which includes bases 344A and 344B and rudder 348. Rudder 348 extends generally the height of exhaust port 332 and has tapered ends 352 connected to bases 344A and 344B. Protrusions of bases 344A and 344B, in turn, are positioned loosely in recesses in exterior 340 of exhaust port 332, thereby permitting rudder 348 to pivot about an (imaginary) axis paralleling the height of exhaust port 352. At least one of bases 344A and 344B is placed to limit travel of sleeve 328 along exterior 340 when contacted by surface 336. Travel of sleeve 328 may also be restricted by stops 356 opposite exhaust port 332 from rudder assembly 316.

As cleaner 308 moves in use, water drag resulting from the motion impacts surface 324, forcing resistance plate 312 to move along exterior 340 toward rudder assembly 316. Surface 336 of sleeve 328 eventually contacts corresponding surfaces 356A and 356B of bases 344A and 344B, respectively, which surfaces 356A and 356B are flush with surface 336 over substantially their entire widths in the embodiment of cleaner 308 shown in FIGS. 9–11. As a consequence, the contact effectively locks, or fixes, rudder 348 in a neutral position (see, e.g., FIG. 10) with respect to the stream exiting exhaust port 332, causing cleaner 308 to travel in a substantially straight line or path (i.e. unaffected by the presence of rudder 348).

When cleaner 308 encounters an obstacle and its motion ceases, resistance plate 312 is no longer subject to motion-induced water drag. In part caused by its momentum, resistance plate 312 rebounds slightly when cleaner 308 stops, removing the contact between surface 336 of sleeve 328 and corresponding surfaces 356A and 356B of bases 344A and 344B. Because the water flow exiting exhaust port 332 is turbulent, rudder 348 when unlocked is unstable and moves to one side or the other. Its motion causes body 304 to spin, reorienting cleaner 308 until the obstacle no longer prevents forward motion from resuming. Upon such resumption water drag again forces sleeve 328 against bases 344A and 344B, locking rudder 348 in its neutral position to generate straight-line motion until another obstacle is encountered. Cleaner 308 is thus less likely than many conventional cleaners to remain impeded for any substantial length of time by obstacles within a vessel to be cleaned.

The foregoing is provided for purposes of illustrating, explaining, and describing embodiments of the present invention. Modifications and adaptations to these embodiments will be apparent to those skilled in the art and may be made without departing from the scope or spirit of the invention.

We claim:

1. An automatic swimming pool cleaner having a body capable of moving linearly within a swimming pool and with a port defining a path through which fluid is exhausted when the cleaner is in use, comprising:

a. a steering mechanism connected to the body in the path of the exhausted fluid; and b. means for selectively fixing the steering mechanism relative to the path of the exhausted fluid configured so as:

I. to contact the steering mechanism when the body is moving linearly within the swimming pool; and ii. not to contact the steering mechanism when the body is obstructed from moving linearly within the swimming pool.

2. An automatic swimming pool cleaner according to claim 1 in which the port has a height and the steering mechanism comprises a rudder adapted to pivot about an axis parallel to the height.

3. An automatic swimming pool cleaner according to claim 2 in which the means for selectively fixing the steering mechanism is adapted to move relative to the port and comprises means for contacting the steering mechanism when in a first position.

4. An automatic swimming pool cleaner according to claim 3 in which the means for selectively fixing the steering mechanism further comprises a curved surface.

5. An automatic swimming pool cleaner according to claim 1 in which the means for selectively fixing the steering mechanism is adapted to move relative to the port and comprises means for contacting the steering mechanism when in a first position.

6. An automatic swimming pool cleaner according to claim 5 in which the means for selectively fixing the steering mechanism further comprises a curved surface.

7. An automatic swimming pool cleaner comprising:

a. a body defining a fluid inlet and a first fluid outlet;

b. a pipe connected to the body, having an exterior, and defining a second fluid outlet through which fluid is exhausted in a path;

c. a rudder assembly connected to the pipe in the path of the exhausted fluid and comprising:

i. a rudder; and ii. a base, having a surface, for connecting the rudder to the pipe; and d. a resistance plate adapted to move along the exterior of the pipe and comprising means for selectively contacting the surface of the base so as to fix the rudder in the path of the exhausted fluid.

8. An automatic swimming pool cleaner having a body with a port defining a path through which fluid is exhausted when the cleaner is in use, comprising:

a. an inlet for receiving fluid from the swimming pool with debris entrained therein;

b. means, at least partially within the body, for separating debris from the fluid and retaining the separated debris;

c. a positionable steering mechanism connected to the body in the path of the exhausted fluid; and d. means for selectively fixing a position of the steering mechanism relative to the path of the exhausted fluid.

9. An automatic swimming pool cleaner according to claim 8 in which the port has a height and the steering mechanism comprises a rudder adapted to pivot about an axis parallel to the height.

10. An automatic swimming pool cleaner according to claim 9 in which the means for selectively fixing a position of the steering mechanism is adapted to move relative to the port and comprises means for contacting the steering mechanism when in a first position.

11. An automatic swimming pool cleaner according to claim 10 in which the means for selectively fixing a position of the steering mechanism further comprises a curved surface.

12. An automatic swimming pool cleaner according to claim 8 in which the means for selectively fixing a position of the steering mechanism is adapted to move relative to the port and comprises means for contacting the steering mechanism when in a first position.

13. An automatic swimming pool cleaner according to claim 12 in which the means for selectively fixing a position of the steering mechanism further comprises a curved surface.

14. An automatic swimming pool cleaner according to claim 8 in which (i) the body is capable of moving linearly within the swimming pool and (ii) the means for selectively fixing a position of the steering mechanism is configured so as:

(A) to contact the steering mechanism when the body is moving linearly within the swimming pool; and (B) not to contact the steering mechanism when the body is obstructed from moving linearly within the swimming pool.

* * * * *